US007102483B2

(12) United States Patent
Hwang et al.

(10) Patent No.: US 7,102,483 B2
(45) Date of Patent: Sep. 5, 2006

(54) MULTI-LAYER OVER-CURRENT PROTECTOR

(75) Inventors: Ren-Haur Hwang, Taoyuan (TW); Chien-Shan Huang, Banciao (TW); Rei-Yian Chen, Hsinchu Hsien (TW); Jui-Kuang Chang, Taoyuan (TW)

(73) Assignee: Protectronics Technology Corporation, Taoyuan (TW)

( * ) Notice: Subject to any disclaimer, the term of this patent is extended or adjusted under 35 U.S.C. 154(b) by 0 days.

(21) Appl. No.: 11/008,933

(22) Filed: Dec. 13, 2004

(65) Prior Publication Data

US 2005/0200445 A1 Sep. 15, 2005

(30) Foreign Application Priority Data

Mar. 9, 2004 (TW) ..... 93203576 U

(51) Int. Cl.
*H01C 7/10* (2006.01)

(52) U.S. Cl. ..... 338/22 R; 338/328; 338/332

(58) Field of Classification Search ..... 338/22 R, 338/22 SD, 313, 328, 332
See application file for complete search history.

(56) References Cited

U.S. PATENT DOCUMENTS

| | | | | |
|---|---|---|---|---|
| 6,040,755 | A * | 3/2000 | Abe et al. | 338/22 R |
| 6,311,390 | B1 * | 11/2001 | Abe et al. | 29/612 |
| 6,400,251 | B1 * | 6/2002 | Abe et al. | 338/22 R |
| 6,429,533 | B1 * | 8/2002 | Li et al. | 257/783 |
| 6,838,972 | B1 * | 1/2005 | Minervini et al. | 338/22 R |
| 2003/0227368 | A1 * | 12/2003 | Huang et al. | 338/22 R |
| 2004/0027230 | A1 * | 2/2004 | Chiang et al. | 338/22 R |
| 2004/0090304 | A1 * | 5/2004 | Hetherton et al. | 338/22 R |

* cited by examiner

*Primary Examiner*—Tu Hoang
(74) *Attorney, Agent, or Firm*—Troxell Law Office, PLLC

(57) ABSTRACT

An over-current protector comprised of multiple over-current protection devices each at various switching temperature and provided with positive temperature coefficient; all devices being stacked and segregated with an reinforced insulation layer and connected in parallel through a conducting mechanism each respectively provided at where in relation to both ends of the device; both conducting mechanisms constituting the terminal electrodes of the over-current protector as a whole for reducing initial resistance, increasing peak resistance, and in turn upgrading voltage withstanding performance.

6 Claims, 3 Drawing Sheets

MULTI-LAYER OVER-CURRENT PROTECTOR

BACKGROUND OF THE INVENTION (a) Field of the Invention

The present invention is related to an over-current protector, and more particularly to one that reduces initial resistance, increase peak resistance, and upgrade high voltage withstanding performance.

(b) Description of the Prior Art

Being compact and multi-purpose dominate the design in consumer electronic products today including the handset, Notebook, digital camera (video camera), and PDA. Similarly, the high-efficacy and compact electric installations are demanded for providing good circuit configuration, assurance of normal operation of the entire electric circuitry, and prevention of shortage due to over-current, or over-temperature to the secondary battery or the circuit device.

Therefore, the design of over-current protection circuit has to meet the requirements of high-efficacy and compactness. Over-current protection devices generally available in the market are usually built up with positive temperature coefficient (PTC). They feature lower resistance at low temperature to permit smooth flow of current, and when the electric installation heats up, its temperature rises to a certain, critical temperature, the resistance would drastically increase up to several tens of thousand folds to achieve its purpose of protecting the battery or the circuit device.

However, in practical use, conducting filling material is reduced to increase peak resistance in response to the characteristic of energy consumption; in turn, the initial resistance is also increased to compromise its conductivity.

SUMMARY OF THE INVENTION

The primary purpose of the present invention is to provide a multi-layer over-current protector that reduces initial resistance, increase peak resistance, and upgrade voltage-withstanding performance. To achieve the purpose, the present invention is comprised of multiple over-current protection devices stacked and segregated with a reinforced insulation layer, two conducting mechanisms are respectively provided on the insulation layer at where in relation to both ends of each over-current protection device to connect all the over-current protection device in parallel, and to become the terminal electrode for the entire over-current protector.

DETAILED DESCRIPTION OF THE PREFERRED EMBODIMENTS

Figure 1:
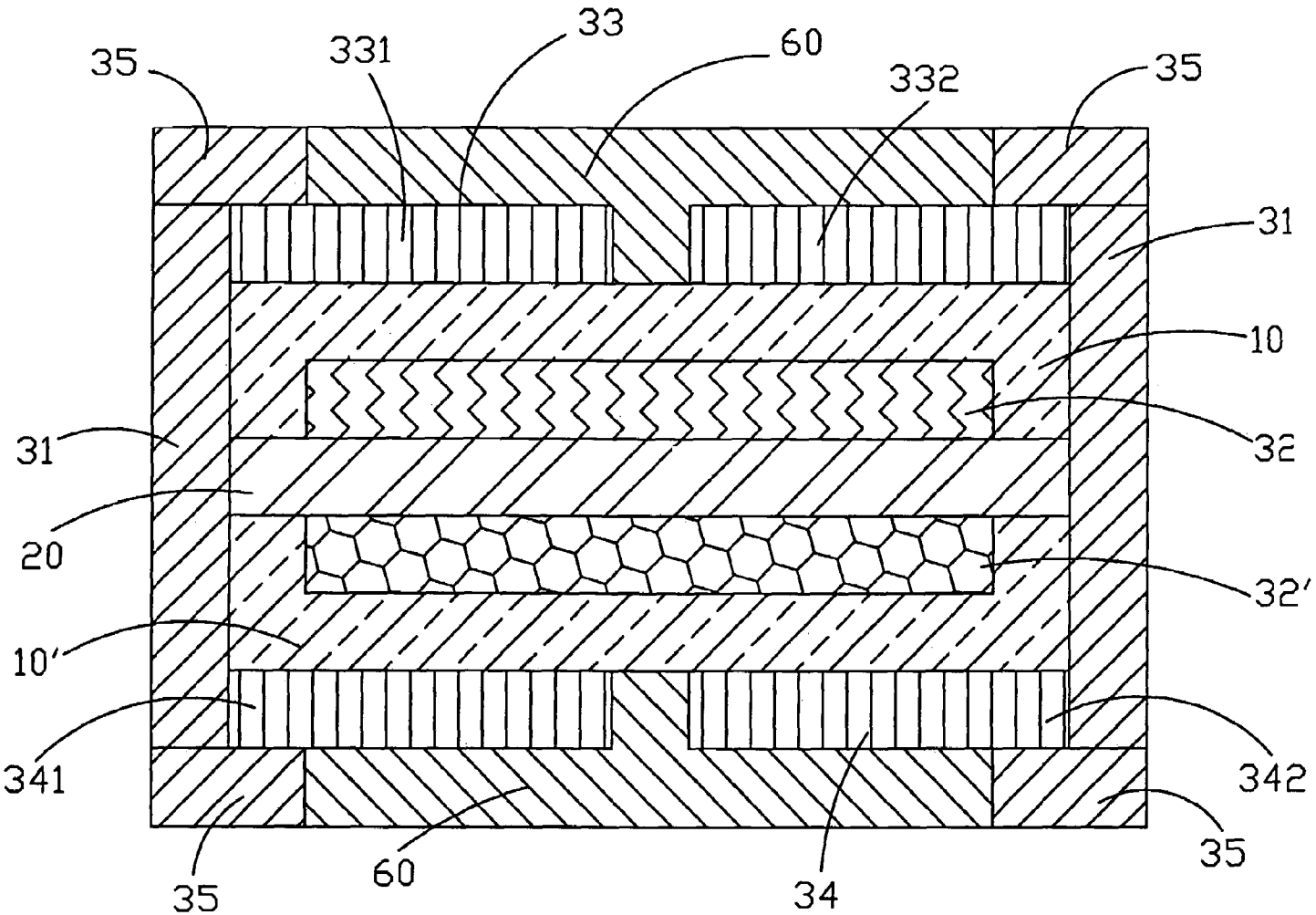
FIG. 1 is a sectional view of a first preferred embodiment of the present invention.

Referring to FIG. 1, a preferred embodiment of the present invention has two over-lapped protection devices 10, 10 stacked to each other. The over-current protection device may be of the so-called thermistor device. Both devices 10, 10 are made of different polymers (e.g., polyolefin polymer or epoxy) and different conducting fillings (e.g., carbon black, metal powder and ceramic powder) so to make both over-current protection devices 10, 10 to have different switching temperatures. Both over-current protection devices 10, 10 are segregated by an reinforced insulation layer 20, and a conducting mechanism 31 is each provided to the insulation layer 20 at where in relation to both ends of the over-current protection devices 10, 10 so to connect both over-current protection devices 10, 10 in parallel. Both conducting mechanisms 31 constitute the terminal electrode for the entire over-current protector that reduces initial resistance, increases peak resistance, and in turn upgrades voltage-withstanding performance.

In the first preferred embodiment, a first and a second conducting layers 32, 32 are provided at where the reinforced insulation layer 20 is attached to both of the over-current protection devices 10, 10. A first electrode layer 33 respectively connected to the conducting mechanism 31 is provided at where between the upper over-current protection device 10 and an insulation layer 60 provided on top of the over-current protection device 10. The first electrode layer 33 is comprised of two parts, respectively, a first member 331 of the first electrode layer 33 and a second member 332 of the first electrode layer 33. A second electrode layer 34 respectively connected to the conducting mechanism 31 is provided at where between the lower over-current protection device 10 and an insulation layer 60 provided on the bottom of the over-current protection device 10. The second electrode layer 34 is comprised of two parts, respectively, a first member 341 of the second electrode layer 34 and a second member 342 of the second electrode layer 34. One terminal electrode 35 is each respectively provided to the first and the second members 331, 332 of the first electrode layer 33 as well as the first and the second members 341, 342 of the second electrode layer 34 to create a parallel circuit as illustrated in FIG. 1.

Figure 2:
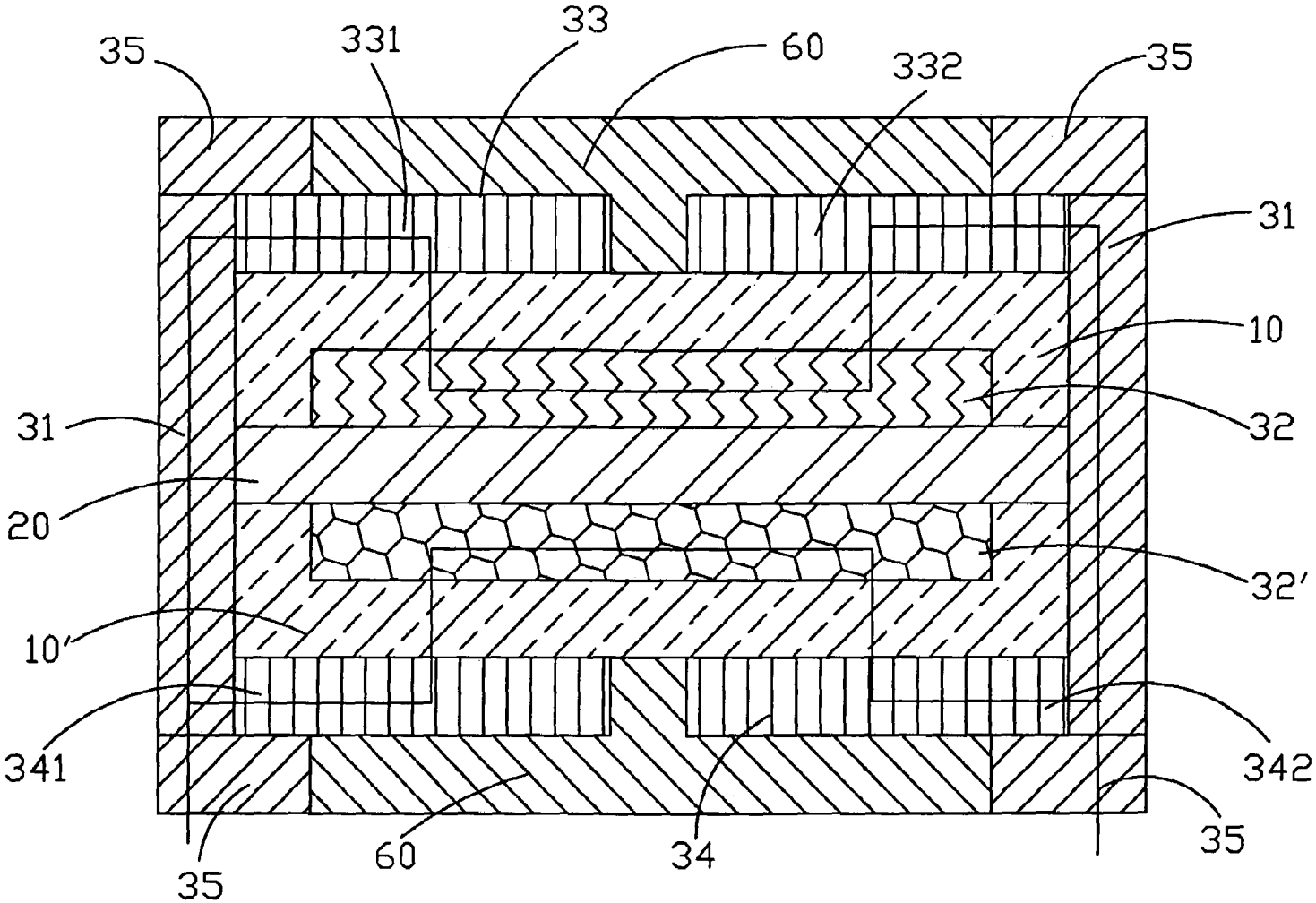
FIG. 2 is a schematic view showing the flow of the current in the first preferred embodiment of the present invention.

As illustrated in FIG. 2, the current enters from the terminal electrode 35 at the first member 341 of the second electrode layer 34 flows first through the conducting mechanism 31 at one end, then respectively through the first member 331 of the first electrode layer 33 and the first member 341 of the second electrode layer 34 into the upper and the lower over-current protection devices 10, 10 into the first and the second conducting layer 32, 32 then returning into the upper and the lower over-current protection devices 10, 10 from there, the current respectively flows through the second member 332 of the first electrode layer 33 and the second member 342 of the second electrode layer 34; at last, jointly flowing through the conducting mechanism 31 provided on the other end to exit from the terminal electrode 35 disposed at the second member 342 of the second electrode layer 34 to complete an integral cycle of a parallel circuit.

Figure 3:
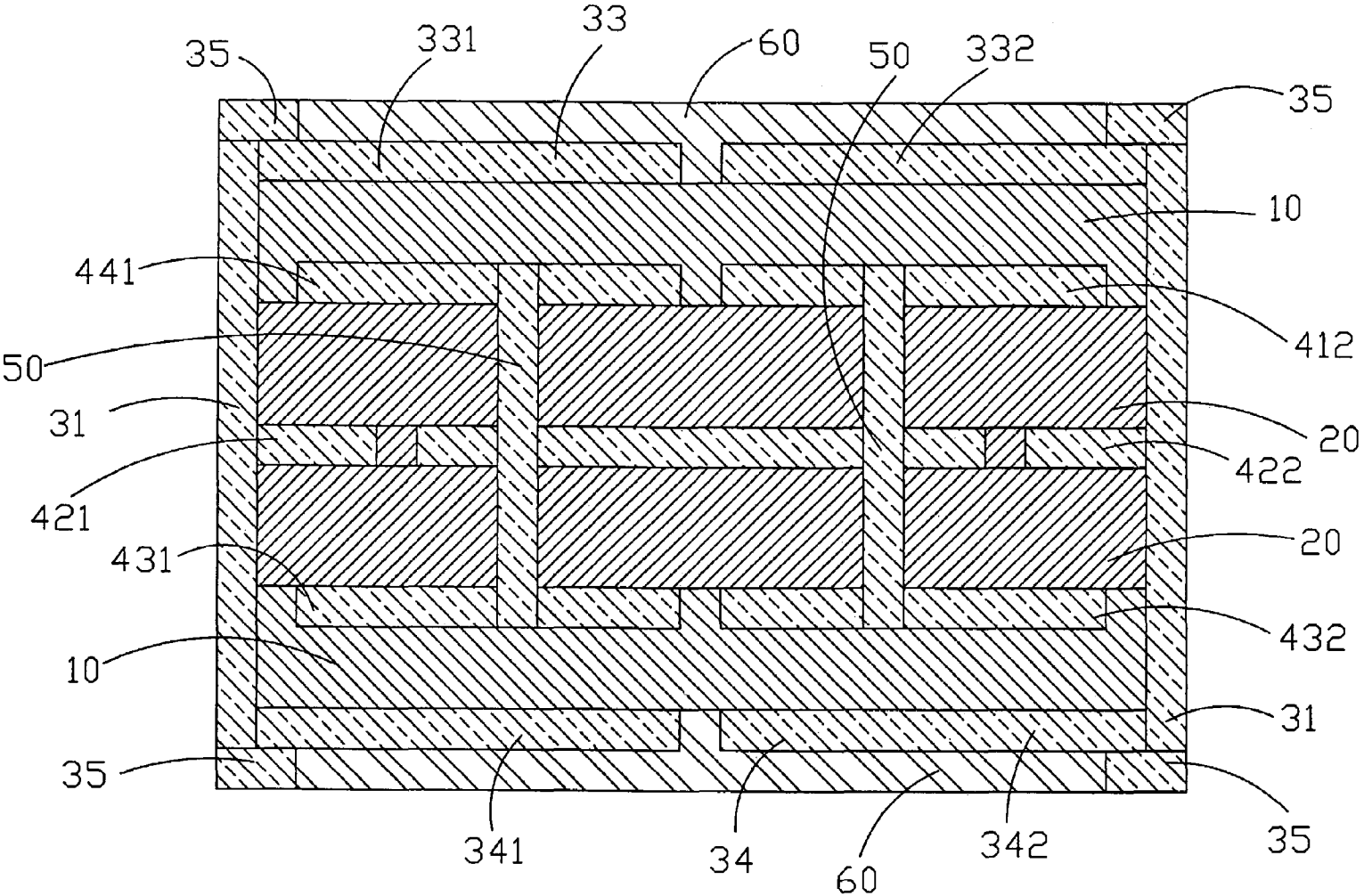
FIG. 3 is a sectional view of a second preferred embodiment of the present invention.

As illustrated in FIG. 3 for a second preferred embodiment of the present invention, the construction of the entire over-current protector has respectively provided a first and a second conducting parts 411, 412 of a first conducting layer 41, and a first and a second conducting parts 431, 432 of a third conducting layer 43 at where between both over-current protection devices 10, 10 are attached to the reinforced insulation layer 20, a first and a second conducting parts 421,422 of a second conducting layer 42 disposed between both reinforced insulation layers 20. The first and the second conducting parts 411, 412 of the first conducting layer 41 as well as the first and the second conducting parts 431, 432 of the third conducting layer 43 disposed between both over-current protection devices 10, 10 do not physically contact with both conduction mechanisms 31 provided on both sides of the over-current protector. Instead a conducting device 50 is provided to connect each of the conducting layers disposed between both over-current protection devices 10, 10. The first and the second conducting parts 421 422 of the second conducting layer 42 disposed between both reinforced insulation layers 20 have physical contact with both conducting mechanisms 31 on both sides of the over-current protector.

Similarly, the first electrode layer 33 respectively connected to both conducting mechanisms 31 is provided at where between the upper over-current protection device 10 and an insulation layer 60 is provided on the top of the upper over-current protection device 10. The first electrode layer 33 includes two separately provided first and second members 331, 332 while the second electrode layer 34 respectively connected to both conducting mechanisms 31 is provided at where between the lower over-current protection device 10 and an insulation layer 60 is provided on the bottom of the lower over-current protection device 10 The second electro layer 34 includes two separately provided second electrode layer 34 includes two separately provided first and second3 members 341, 342. Two terminal electrode 35 are respectively provided to the first and the second members 331, 332 of the first electrode layer 33 as well as the first and the second members 341, 342 of the second electrode layer 34 to create the parallel circuit as illustrated in FIG. 3. The present invention by providing multiple over-current protection devices of the same resistance but at different switching temperatures connected in parallel to reduce initial resistance, increase peak resistance, and in turn upgrade voltage-withstanding performance.

The present invention provides an improved structure of an over-current protector; therefore, this application for a utility patent is duly filed accordingly. However, it is to be noted that the preferred embodiments disclosed in the specification and the accompanying drawings are not limiting the present invention; and that any construction, installation, or characteristics that is same or similar to that of the present invention should fall within the scope of the purposes and claims of the present invention.

We claim:

1. A multi-layer over-current protector to reduce initial resistance, increase peak resistance, and in turn upgrade voltage-withstanding performance comprising:

multiple over-current protection devices stacked on one another and segregated by at least one reinforced insulation layer between two abutted over-current protection devices;

a conducting mechanism being each provided on both sides of the over-current protection devices at both ends of those over-current protection devices to connect all the over-current protection devices in parallel, both conducting mechanisms constituting the terminal voltage of the entire over-current protector; and a first and a second conducting parts of a first conducting layer and a first and a second conducting parts of a third conducting layer are respectively provided to where each over-current protection device is attached to the reinforced insulation layer, wherein both of the first and the second conducting parts of the first conducting layer as well as the first and the second conducting parts of the third conducting layer do not have any physical contact with both conducting mechanisms on both sides of the over-current protector, a conducting device instead directly connecting the conducting parts of each layer of the over-current protection device, the conducting layers being disposed between the over-current protection devices.

2. The multi-layer over-current protector of claim 1, wherein, an insulation layer being provided to the top of the upper over-current protection device disposed on the utmost top of the over-current protector;

a first electrode layer including a first member and a second member being provided between the first insulation layer and the upper over-current protection device to respectively connect to both conducting mechanisms on both sides of the over-current protector;

another insulation layer being provided to the bottom of the lower over-current protection device disposed on the utmost bottom of the over-current protector; and a second electrode layer including a first member and a second member being provided between the second insulation layer and the lower over-current protection device to respectively connect to both conducting mechanisms on both sides of the over-current protector.

3. The multi-layer over-current protector of claim 2, wherein, the first and the second members of the first electrode layer as well as the first and the second members of the second electrode layer are respectively provided with a terminal electrode.

4. The multi-layer over-current protector of claim 1, wherein the at least one reinforced insulation layer comprises a first and a second reinforced insulation layer, the first and the second conducting parts of the first conducting layer are both disposed on a surface of the first reinforced insulation layer and the first and the second conducting parts of the third conducting layer are both disposed on a surface of the second reinforced insulation layer.

5. The multi-layer over-current protector of claim 4, wherein, the surface of the first reinforced insulating layer extends beyond the first conducting layers and a surface of the second reinforced insulating layer extends beyond the second conducting layer.

6. The multi-layer over-current protector of claim 1, wherein the conducting device extends through the at least one reinforced insulation layer.

* * * * *